US012064014B2

(12) United States Patent
Bernhard et al.

(10) Patent No.: US 12,064,014 B2
(45) Date of Patent: Aug. 20, 2024

(54) RUNNING SHOE WITH ADAPTIVE UPPER MATERIAL

(71) Applicant: ON CLOUDS GMBH, Zürich (CH)

(72) Inventors: Olivier Bernhard, Heiden (CH); Ilmarin Heitz, Zürich (CH); Dina Weisheit, Erlinsbach (CH)

(73) Assignee: ON CLOUDS GMBH, Zurich (CH)

( * ) Notice: Subject to any disclaimer, the term of this patent is extended or adjusted under 35 U.S.C. 154(b) by 240 days.

(21) Appl. No.: 17/621,775

(22) PCT Filed: Jun. 29, 2020

(86) PCT No.: PCT/EP2020/068246
§ 371 (c)(1),
(2) Date: Dec. 22, 2021

(87) PCT Pub. No.: WO2020/260693
PCT Pub. Date: Dec. 30, 2020

(65) Prior Publication Data
US 2022/0240626 A1 Aug. 4, 2022

(30) Foreign Application Priority Data
Jun. 28, 2019 (CH) ..... 866/19

(51) Int. Cl.
*A43C 11/00* (2006.01)
*A43B 23/02* (2006.01)
*A43B 23/22* (2006.01)

(52) U.S. Cl.
CPC ..... *A43C 11/006* (2013.01); *A43B 23/027* (2013.01); *A43B 23/227* (2013.01)

(58) Field of Classification Search
CPC ..... A43B 23/227; A43B 23/22; A43B 23/028; A43B 7/20; A43B 7/24; A43B 5/06;
(Continued)

(56) References Cited

U.S. PATENT DOCUMENTS 6,298,582 B1 * 10/2001 Friton ..... A43B 23/027 36/102
6,367,168 B1 * 4/2002 Hatfield ..... A43B 7/06 36/7.1 R (Continued)

FOREIGN PATENT DOCUMENTS

GB 2481369 A * 12/2011 ..... A43B 5/06
WO WO 2016/055642 A1 4/2016

OTHER PUBLICATIONS

EPO (Riswijk, NL), English language version of the International Search Report, Form PCT/ISA/210, for International Application PCT/EP2020/068246, Oct. 2, 2020 (2 pages).

*Primary Examiner* — Aiying Zhao
(74) *Attorney, Agent, or Firm* — Pauley Erickson & Swanson

(57) ABSTRACT

A running shoe with a lateral side, a medial side, a heel section, a forefoot section, and a midfoot section. A front end of the forefoot section forms a toe box and a rear end of the heel section forms a heel counter. The running shoe includes a sole and an upper, wherein the upper has a textile main material. The running shoe has tightening bands with at least one compressing tightening band and tensioning bands with at least one compressing tensioning band. The tightening bands are arranged in the heel section and in the midfoot section of the running shoe and in the forefoot section. At least one tightening band is configured to exert an inwards-directed compression force when the shoe is worn and is configured to run along a non-expanding line (line of non-extension) of the foot of the wearer when the shoe is worn.

20 Claims, 4 Drawing Sheets

(58) Field of Classification Search
CPC ..... A43B 11/00; A43C 11/004; A43C 11/006; A43C 11/008
See application file for complete search history.

(56) References Cited

U.S. PATENT DOCUMENTS

| | | | | |
|---|---|---|---|---|
| 2010/0269369 | A1* | 10/2010 | Nishiwaki | A43B 23/047 36/28 |
| 2011/0113650 | A1* | 5/2011 | Hurd | A43B 7/20 36/107 |
| 2011/0308108 | A1* | 12/2011 | Berns | A43B 5/02 36/50.1 |
| 2012/0204448 | A1* | 8/2012 | Bracken | A43B 9/02 36/103 |
| 2013/0255105 | A1* | 10/2013 | Bishop | A43B 23/07 36/25 R |
| 2014/0310984 | A1* | 10/2014 | Tamm | A43B 1/04 36/45 |
| 2016/0174660 | A1* | 6/2016 | Iuchi | A43B 23/0265 36/45 |
| 2016/0174661 | A1* | 6/2016 | Nonogawa | A43B 23/0235 36/88 |

* cited by examiner

RUNNING SHOE WITH ADAPTIVE UPPER MATERIAL

CROSS REFERENCE TO RELATED APPLICATION

This application is a National Phase filing in the United States, under 35 USC § 371, of PCT International Patent Application PCT/EP2020/068246, filed on 29 Jun. 2020 which claims the priority of Swiss Patent Application CH 00866/19, filed 28 Jun. 2019.

These applications are hereby incorporated by reference herein in their entirety and is made a part hereof, including but not limited to those portions which specifically appear hereinafter.

BACKGROUND OF THE INVENTION

Field of the Invention

The present invention relates to the field of footwear technology. More particularly, the invention relates to a running shoe having an adaptive upper.

Discussion of Related Art

Running shoes, for example sports shoes, tennis shoes, hiking shoes or leisure shoes, are typically retained on the wearer's foot by means of laces or hook and loop fasteners. Hook and loop fasteners have the disadvantage that although they can be easily closed and opened, they lose their original fastening effect after only a short time. Shoelaces, on the other hand, have the disadvantage that they often lead to unpleasant pressure points and the knots can come loose while running, which is especially undesirable during sports. Furthermore, the overall weight of a running shoe is becoming increasingly important, especially in the field of professional sports. Both the use of hook and loop fasteners and laces requires additional components and materials that increase the overall weight of the running shoe.

In the prior art, shoes are known which have no lacing. For example, it is known to provide a shoe with an elastic textile upper which is highly compressed in the unworn state. As soon as the wearer pulls the shoe over the foot, the elastic upper is stretched and pressed against the foot.

SUMMARY OF THE INVENTION

However, in the known shoes without lacing, the hold of the foot in the shoe is significantly reduced compared to common shoes with lacing. While a lower hold in leisure shoes is tolerable due to the slow walking speeds of the wearer, the risk of injury during sports increases significantly with such shoes. There are no known fastener-free running shoes that provide good support during sports and can thus adequately replace the common laced embodiments. In particular, it is a problem with lacing-free running shoes to hold the wearer's foot above the sole of the shoe in such a way that the foot cannot slip beyond the periphery of the shoe sole, so that twisting is prevented even when stepping at an angle.

It is therefore the general object of the invention to improve the state of the art in the field of fastener-free running shoes and preferably to overcome one or more of the disadvantages of the prior art.

In some embodiments, a fastener-free running shoe is provided that provides comparable or better support to a laced running shoe.

In further embodiments, a fastener-free running shoe is provided which has a particularly low weight.

In some embodiments, a fastener-free running shoe is provided that stabilizes the wearer's foot while running and is comfortable to wear.

The general object is solved by the independent patent claim. Further advantageous embodiments result from the dependent patent claims, as well as the description and the drawings.

One aspect of the invention relates to a running shoe having a lateral side and a medial side. The running shoe has a heel area (FB), a forefoot area (VB), a midfoot area (MB). The front end of the forefoot area¬ forms a shoe tip and the rear end of the heel area forms a heel edge. The running shoe includes a shoe sole and an upper, the upper having a textile base material. In addition, the running shoe has a group of tension straps having at least one compressive tension strap and a group of pulling straps having at least one compressive pulling strap. The group of tension straps and the group of pulling straps are thereby part of the upper and may optionally each extend into or be attached to the sole of the shoe. The group of tension straps is arranged in the heel area and in the midfoot area of the running shoe, and the group of pulling straps is arranged in the forefoot area. In this case, the at least one tension strap is configured such that it exerts an inwardly directed compression force in the worn state. In addition, the at least one tension strap is arranged such that it runs along a non-expanding line (LONE—line of non-extension) of the wearer's foot in the worn state. This means that the tension strap typically runs exclusively on the LONE respectively is arranged above the LONE of the wearer's foot. Thus, when worn, a compressive force acts on the wearer's foot along a LONE. Preferably, the pressure that additionally acts on the foot of the wearer through the at least one tension strap may be between 0 and 100 mmHg (0 to 0.15 atm), preferably between >0 and 100 mmHg (>0 to 0.15 atm). The at least one tension strap may provide a tensile force on the upper of the running shoe.

Preferably, the group of tension straps is arranged only in the heel area and in the midfoot area, but not in the forefoot area, and the group of pulling straps is arranged only in the forefoot area, but not in the heel area. Preferably, the at least one tension strap may be disposed in the heel area such that it extends along a LONE of the wearer's foot in the worn state. Typically, the at least one pulling strap extends from the lateral side of the shoe sole across the running shoe to the medial side of the shoe sole. Optionally, a pulling strap may extend from the medial side of the shoe sole toward, and merge with, a second pulling strap, and thus, in combination with the second pulling strap, extend from the medial side shoe sole across the running shoe toward the shoe sole on the lateral side. Preferably, the at least one tension strap is disposed exclusively above the LONE of the wearer's foot, and/or disposed exclusively above an area of LONES. An area of LONES refers to an area formed by a group of LONES extending in the same direction over the foot of the wearer. In particular, the area can be delimited or defined by the outer two LONES of the group.

In some embodiments, the group of tension straps surrounds the entry opening from substantially all sides.

The upper of the running shoe typically completely encloses the wearer's foot in the worn state. Thus, the foot is not directly exposed or accessible to the environment.

A running shoe within the meaning of the present invention may preferably denote a closed shoe. In particular, it may be a sports shoe for athletics, tennis, hiking, trekking or the like, or a leisure shoe. The skilled person understands that the medial side of the running shoe in the worn state denotes the outer inner side of the shoe. Thus, in a pair of running shoes, the two medial sides face each other. When worn, the lateral side of the running shoe denotes the outer side of the shoe and is thus on the side of the outer instep. Typically, the forefoot area is located in the area of the toes and the ball of the foot, and the heel area is located in the area of the heel. The midfoot area lies between the heel area and the forefoot area. The length of the forefoot area in the longitudinal direction can be, for example, 40-55%, the heel area in about 25-35%, and the midfoot area about 10-35% of the total length of the shoe sole. The heel edge is located opposite the shoe tip and thus denotes the vertical rear edge of the running shoe.

In some embodiments, the running shoe is a fastener-free running shoe. For purposes of the invention, a fastener-free running shoe refers to a running shoe that does not have laces, zippers, hook and loop fasteners, buttons, snap closures, or similar fasteners and attachments.

The group of tension straps or the pulling straps may each comprise only one tension strap or pulling strap or several tension straps or pulling straps. The skilled person understands that the term "the at least one tension/pulling strap" can refer to both the singular and the plural.

Typically, the at least one tension strap and/or the at least one pulling strap is compressed in the unworn state. In the worn state, a strong t force, or compression force, can be exerted.

A tension strap is typically positioned in the upper of the running shoe such that it rests on a "LONE" of the wearer's foot when worn. A LONE is a hypothetical line extending across the wearer's foot that is neither stretched nor compressed during the running motion (see Jenkins, Dressing for Altitude: U.S. Aviation Pressure Suits, Wiley Post to Space Shuttle, U.S. National Aeronautics and Space Administration, ISBN 9780160901102 and Iberall, J. Basic Engineering, 1970, 251-264). If the line describes a closed geometric figure, for example a circle or an ellipse, it does not undergo any circumference change during the running motion. The compressive tension strap exerts a compression on the wearer's foot when at rest. If a tension strap is arranged in the upper in such a way that it lies on a LONE when worn, this has the advantage that the tension strap is essentially not stretched or tightened during the running movement. A compression that is large enough to keep the running shoe on the wearer's foot at rest without exerting an uncomfortable feeling of pressure thus also does not create a feeling of pressure during the running movement. Thus, a relatively strong compression can be employed, which on the one hand causes a good hold of the foot in the running shoe, but on the other hand does not lead to an unpleasant feeling of pressure even during the running movement. Due to the at least one tension strap, a fastener can thus be dispensed with. This has the advantage that less force has to be applied during running, since a fastener, for example a common lacing, causes a restriction of movement which has to be overcome by the runner.

The at least one tension strap and/or the at least one pulling strap typically has two engagement points on the running shoe, in particular on the shoe sole or on the upper part of the running shoe. The points of engagement define the starting and the end point of the tension strap and/or the pulling strap extending at least over the upper part. In embodiments having a plurality of pulling straps and/or having a plurality of tension straps, a plurality of pulling straps and/or tension straps within the respective group of tension straps or group of pulling straps may cross over, make contact with, or merge into one another.

It has been observed that the group of tension straps is preferably arranged in the heel area and midfoot area. In addition, tension straps in the forefoot area can be dispensed with, as their stabilizing effect is required primarily in the heel and midfoot area.

In further embodiments, the at least one pulling strap is arranged in such a way that it can exert a pulling force against the pronation of the foot in the forefoot area. This reduces the angular velocity of pronation during the running movement and increases the cushioning effect during treading. In addition, by reducing the speed of pronation, a stabilizing and supporting function of the foot during running is produced. The at least one compressing pulling strap can be arranged in such a way that a pulling force is exerted from the medial side towards the lateral side of the running shoe, preferably from the medial side of the shoe sole to the lateral side of the shoe sole of the running shoe.

Preferably, the at least one pulling strap is directly connected to the sole of the shoe on both the medial side and the lateral side. Typically, the pulling straps are arranged such that they each, or in conjunction with each other, extend from the medial side across the instep of the wearer's foot to the lateral side.

In some embodiments, the group of pulling straps includes a first pulling strap extending from the shoe sole on the medial side to the shoe sole on the lateral side, which exerts a pulling force between the medial side and the lateral side of the shoe sole. The first pulling strap thus extends over the instep of the foot when worn. The pulling strap may be directly connected to the sole of the shoe or may be located above the sole of the shoe. The pulling strap has the effect of reducing the angular velocity of pronation of the foot during tread, thereby increasing the cushioning effect.

Typically, the first pulling strap can run diagonally from the medial side to the lateral side in the direction of the heel area. This additionally improves the cushioning effect.

In some embodiments, the first pulling strap may be arranged such that it is positioned in front of the hallux of the wearer in the direction of running in the worn state. Preferably, the first tension strap runs tangentially to the hallux.

In further embodiments, the first pulling strap divides the forefoot area of the upper into a first and a second functional zone. In this case, the first functional zone extends from the tip of the shoe to the first pulling strap and is pretensioned in the longitudinal direction. This allows the material to be compressed in the longitudinal direction, i.e., along the tarsal bones (metatarsals) of the wearer, thereby reducing the force to be applied by the wearer during walking. In the latitudinal direction, the first functional zone may be force neutral. The term "force neutral" means that the first functional zone is substantially neither prestressed nor prestretched in the latitudinal direction at rest. In particular, the first functional zone ensures that the foot is maintained above the sole of the shoe and cannot slip partially beyond its periphery.

It is known to the skilled person how a pre-tension, i.e., a contraction, or a pre-expansion, i.e., an expansion of a functional zone can be achieved. For example, this can be achieved during the manufacture of the upper material by sewing under tension, by certain layings of a warp knitted fabric, by close-meshed weaving or knitting, or also by additive manufacturing of the upper part of the running shoe.

In some embodiments, the second functional zone is pre-tensioned in the latitudinal direction and/or pre-stretched in the longitudinal direction. The second functional zone may for example further be delimited by a tension strap, particularly the first tension strap, or another pulling strap. The longitudinal pre-stretching allows the anterior-posterior movement of the foot and the latitudinal pre-tension fixes the foot to the instep and thus replaces essential functions of a lacing without significantly limiting the flexibility of the natural movement of the foot.

In further embodiments, the group of pulling straps includes a second pulling strap extending from the shoe sole on the medial side toward the first pulling strap and exerting a pulling force in the direction of the first pulling strap. The second pulling strap is typically directly connected to the first pulling strap. Preferably, the second pulling strap extends from the medial side obliquely toward the shoe tip in the direction of the first pulling strap.

In some embodiments, the second tension strap may be arranged such that it is positioned behind the hallux of the wearer in the direction of running in the worn state. Preferably, the second pulling strap extends tangential to the hallux. In particular, the hallux may be surrounded by the first and second pulling straps in the worn state.

In further embodiments, the first and second pulling straps define a third functional zone. Optionally, the third functional zone may have a substantially triangular shape formed by the first and second pulling straps, and the shoe sole. In this regard, the third functional zone may be elastically formed, thereby providing a comfortable fit for various hallux shapes and hallux sizes.

In some embodiments, the group of tension straps includes a first tension strap extending from the medial side of the shoe sole to the lateral side of the shoe sole and disposed in the midfoot area of the running shoe. In this regard, the first tension strap may extend over the instep of the wearer's foot in the worn state. Typically, the first tension strap extends in the running direction in front of the entry opening of the running shoe. Preferably, the first tension strap is arranged such that it lies on a LONE of the wearer's foot in the worn state. The first tension strap fixes the foot of the wearer and prevents an unwanted vertical movement of the foot relative to the running shoe.

Preferably, the first tension strap has a medial engagement point in the midfoot area. This can, for example, be arranged in the running direction starting from the heel edge at about 20 to 40%, preferably 30 to 35%, of the total length of the running shoe. Furthermore, the first tension strap can have a lateral engagement point in the midfoot area. This can be arranged, for example, in the running direction starting from the heel edge at about 20 to 40%, preferably 30 to 35%, of the total length of the running shoe.

In further embodiments, the first tension strap and the shoe sole define a fourth functional zone in the midfoot area and the heel area that is force neutral in all directions. This ensures that the function of the tension strap or straps is not affected by pre-tensioning or pre-stretching of the fourth functional zone.

The fourth functional zone can comprise the entire midfoot area and heel area. In particular, the fourth zone can be subdivided by further tension straps into sub-zones, which can typically all be designed to be force-neutral or can also be partially pre-tensioned and/or pre-stretched.

In some embodiments, the group of tension straps includes a second tension strap extending on the medial side in the heel area and rise vertically from the shoe sole at the heel edge to the first tension strap. In particular, the second tension strap may be directly connected to the first tension strap. For example, the second tension strap may be disposed only on the medial side of the running shoe and not on the lateral side. The second tension strap can rise continuously in the vertical direction or rise vertically only on a partial section and be arranged partially horizontally in the running direction. The second tension strap provides additional stabilization in the heel area. Preferably, the second tension strap is arranged in such a way that it lies on a LONE of the wearer's foot in the worn state.

In further embodiments, the group of tension straps comprises a third tension strap which extends on the lateral side in the heel area and extends vertically ascending from the running shoe sole at the heel edge to the first tension strap. In particular, the third tension strap may be directly connected to the first tension strap. Preferably, the third tension strap is arranged only on the lateral side of the running shoe and not on the medial side. The third tension strap can rise continuously in the vertical direction or rise vertically only on a partial section and be arranged partially horizontally in the running direction. The third tension strap provides additional stabilization in the heel area. Preferably, the third tension strap is arranged in such a way that it lies on a LONE of the wearer's foot in the worn state.

The second and third tension strap has the advantage that a medial or lateral twisting of the wearer's foot during running is prevented even further. This provides an additional increase in the stability of the foot in the running shoe.

In some embodiments, the group of tension straps includes a fourth tension strap that extends in the heel area starting from the medial side of the shoe sole over the heel edge to the lateral side of the shoe sole and has an inclination in the vertical direction. Preferably, the fourth tension strap extends at the heel edge to the entry opening of the running shoe. Preferably, the fourth tension strap is arranged such that it lies on a LONE of the wearer's foot in the worn state. The fourth tension strap efficiently prevents the wearer's foot from slipping over the periphery of the sole of the shoe during the running movement, for example during treading with the heel. The combination of the first and fourth tension straps has proven to be particularly preferred, as these can essentially completely enclose the wearer's foot and hold it firmly in place by the compression force exerted.

Preferably, the fourth tension strap has a medial engagement point in the heel area. This can be arranged, for example, in the running direction starting from the heel edge at about 20 to 30%, preferably 25 to 27%, of the total length of the running shoe. Furthermore, the fourth tension strap may have a lateral engagement point tin the heel area. This can be arranged, for example, in the running direction starting from the heel edge at about 20 to 30%, preferably 25 to 27%, of the total length of the running shoe.

In some embodiments, the first, second, third, and fourth tension straps define a fifth functional zone that is longitudinally and latitudinally pre-tensioned. The fifth functional zone is thus located in the region of the entry opening of the running shoe, and thus compresses the upper of the running shoe in the worn state in the region of the ankles of the foot, thereby enabling a better hold of the running shoe on the foot of the wearer. The fifth functional zone can be formed here, for example, as a subzone of the fourth functional zone.

In further embodiments, the at least one tension strap, or straps, and/or the at least one pulling strap, or straps, has a width of 0.5 to 4 cm. The person skilled in the art understands that the width of the tension strap and the pulling strap is dependent on the shoe size. The tension straps and/or the pulling straps may be arranged on the textile base material, peripherally surrounded by it and/or be part of the textile base material. In particular, it is possible for the width of a particular tension strap to vary.

In some embodiments, the upper comprises an auxetic transition region between the tension strap, or straps, and the textile base material and/or between the pulling strap, or straps, and the textile base material. The transition area can have a width of up to 2 cm, for example, preferably between 0.5 and 2 cm.

In further embodiments, the first, second, third and/or fourth functional zone is auxetic. Preferably, at least the first functional zone is auxetic, which prevents crumpling of the textile base material during the running movement and pressure points on the foot of the wearer resulting therefrom. This can increase the durability and resistance of the upper of the running shoe.

In further embodiments, the at least one tension strap and/or the at least one pulling strap is connected to the shoe sole. For example, it is possible that the at least one tension strap and/or the at least one pulling strap is connected to the sole of the shoe by a material bond, is sewn to the sole of the shoe, rests against the sole of the shoe, or is also at least partially surrounded by the sole of the shoe. Alternatively, the at least one tension strap and/or pulling strap can run above the shoe sole along a surface of the shoe sole. In such embodiments, the at least one tension strap and/or pull strap extend in the worn state below the foot of the wearer.

DETAILED DESCRIPTION OF THE INVENTION

Figure 1:
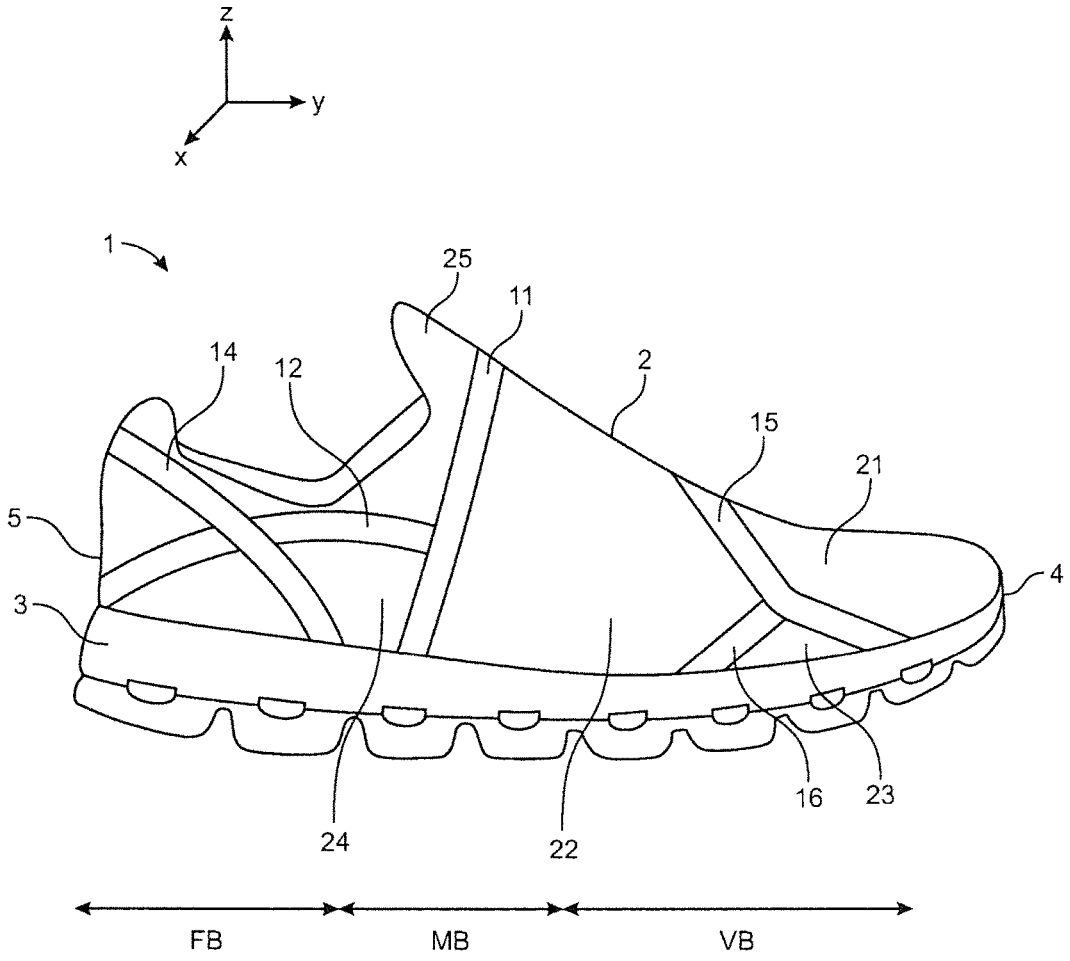
FIG. 1 shows a schematic view on the medial side of a running shoe according to a first embodiment of the invention.

FIG. 1 shows a running shoe 1 according to the invention with a heel area FB, a forefoot area VB and a midfoot area MB. The skilled person understands that the arrows indicate the area boundaries by way of example and do not define sharp area boundaries. According to the coordinate system, the longitudinal direction denotes the running direction of the shoe, i.e., the y-direction. The vertical direction is described by the z-direction. The latitudinal direction is described by the x, or −x direction. The running shoe 1 further comprises a shoe tip 4 and a heel edge 5. Furthermore, the running shoe comprises a shoe sole 3 and an upper 2, wherein the upper 2 comprises a textile base material. In addition, the running shoe comprises a group of pulling straps including a first pulling strap 15 and a second pulling strap 16. The pulling straps 15 and 16 are longitudinally stretchable and exert a pulling force on the upper and the textile base material. In the worn state, the pulling straps 15 and 16 are stretched and, by forming a pulling force against the pronation of the foot, cause the pronation angular velocity to be reduced during walking, thereby increasing the cushioning effect. This effect is further enhanced by the fact that the pulling straps 15 and 16 are each directly connected to the sole of the shoe. In addition, the pulling straps prevent the wearer's foot from partially slipping beyond the periphery of the shoe sole 3. As can be seen in FIG. 1, the second pulling strap 16 extends vertically from the shoe sole on the medial side, i.e., rising in the z-direction, toward the first pulling strap 15, thereby forming a substantially triangular third functional zone 23. The third functional zone is pre-stretched both in the longitudinal direction, i.e., in the y-direction, and in the latitudinal direction, i.e., perpendicular to the longitudinal direction and extending from the medial side to the lateral side across the foot of the wearer in the x-direction. This allows a comfortable fit for different hallux shapes and hallux sizes without feeling uncomfortable pressure on the hallux when walking.

The first pulling strap 15 divides the forefoot area VB into a first functional zone 21 and a second functional zone 22. As shown in FIG. 1, the first functional zone 21 extends from the shoe tip 4 to the first pulling strap 15. The second functional zone 22 is delimited on one hand by the first and second pulling straps 15 and 16, and on the other hand by the first tension strap 11. The first tension strap 11 extends from the medial side of the shoe sole 3 to the lateral side of the shoe sole 3 and is located in the midfoot area. As shown in FIG. 1, the first tension strap 11 extends generally in front of the entry opening of the running shoe 1 as seen from the shoe tip 4. When worn, the first tension strap 11 extends over a LONE of the wearer's foot and causes an inwardly directed compression force, i.e., directed toward the foot, whereby the foot is stabilized and held laterally, i.e., in the x and −x directions, on the one hand, and stabilized and held vertically, i.e., in the z direction, on the other hand. The first tension strap 11 also defines a fourth functional zone 24 of the upper 2, which is arranged behind the first tension strap 11 as seen from the shoe tip 4 and extends from there to the heel edge 5.

Furthermore, the running shoe 1 shown in FIG. 1 comprises second tension strap 12, which runs on the medial side in the heel area FB and extends vertically ascending from the running shoe sole 3 at the heel edge 5 to the first tension strap 11. Generally, a plurality of tension and/or pulling straps may cross, contact or merge with each other. The second tension strap 12 surrounds the wearer's foot from the heel edge over the medial side. Thus, the foot is stabilized in the x-direction. In addition, the compression force exerted on the foot by the tension strap 12 ensures a good hold of the running shoe on the foot. The group of tension straps of the running shoe 1 shown in FIG. 1 also includes a fourth tension strap 14, which in particular ensures a good hold of the rear heel part in the region of the Achilles tendon. The fourth tension strap 14 extends from the medial side of the shoe sole 3 over the heel edge 5 to the lateral side of the shoe sole 3. Moreover, the fourth tension strap 14 rises vertically in the direction of the heel edge, i.e. in the z-direction, and reaches its maximum height in the z-direction at the heel edge 5. The first, second, third (not shown in FIG. 1, see FIG. 2) and fourth tension straps (11-14) define a fifth functional zone 25 which is pre-tensioned in the longitudinal and latitudinal direction. The fifth functional zone 25 is thus located in the region of the entry opening of the running shoe and thus compresses the upper part of the running shoe in the worn state in the region of the ankles.

Figure 2:
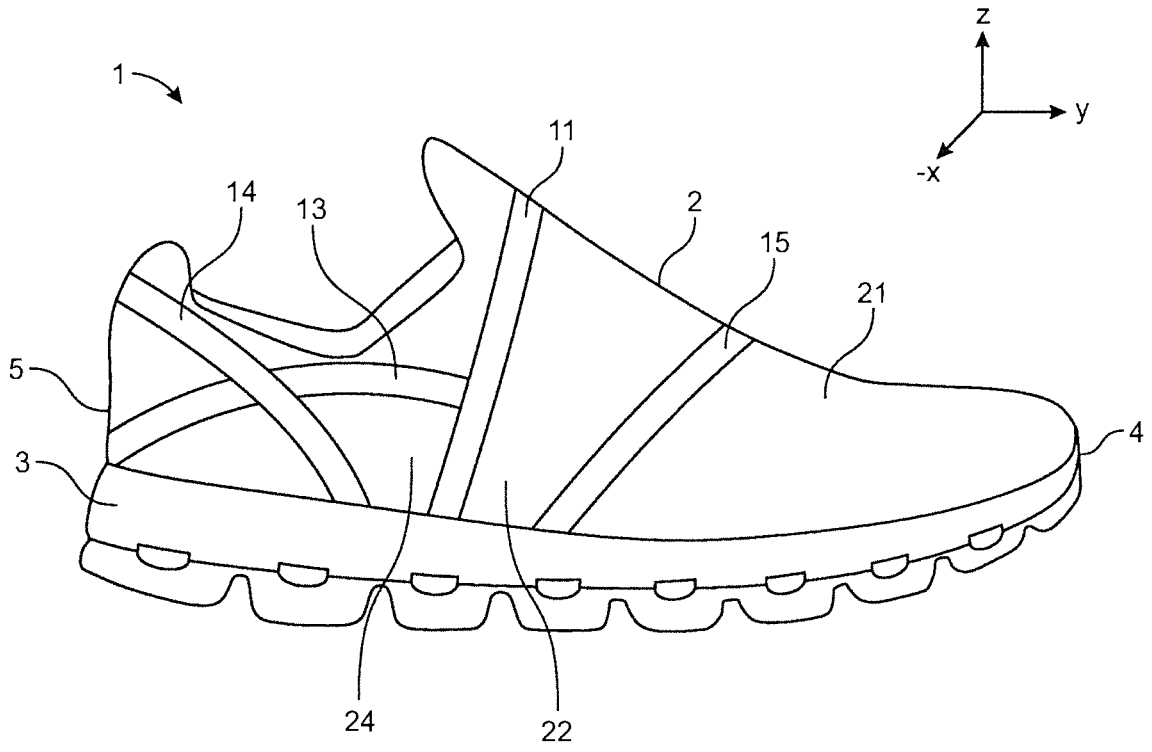
FIG. 2 shows a schematic view on the lateral side running shoe according to a further embodiment of the invention.

FIG. 2 shows the embodiment of the running shoe 1 as a top view on the lateral side. It can be seen that the pulling strap 15 runs obliquely from the engagement point on the medial side to the lateral side at an angle in the direction of the heel area FB. Thus, the engagement point on the lateral side is shifted further towards the heel edge 5 than the engagement point on the medial side. In addition to the first, second and fourth tension straps, the running shoe 1 has a third tension strap 13 which runs on the lateral side in the heel area FB and extends in a vertically ascending manner from the running shoe sole at the heel edge 5 to the first tension strap 11. Equivalent to the second tension strap 12, the tension strap 13 rises continuously in the vertical direction and finally runs horizontally, i.e. in the y-direction. The compressing tension straps 11 to 14 thus exert an inwardly directed force on the wearer's foot essentially from all sides, as a result of which the running shoe is held firmly on the foot.

Figure 3:
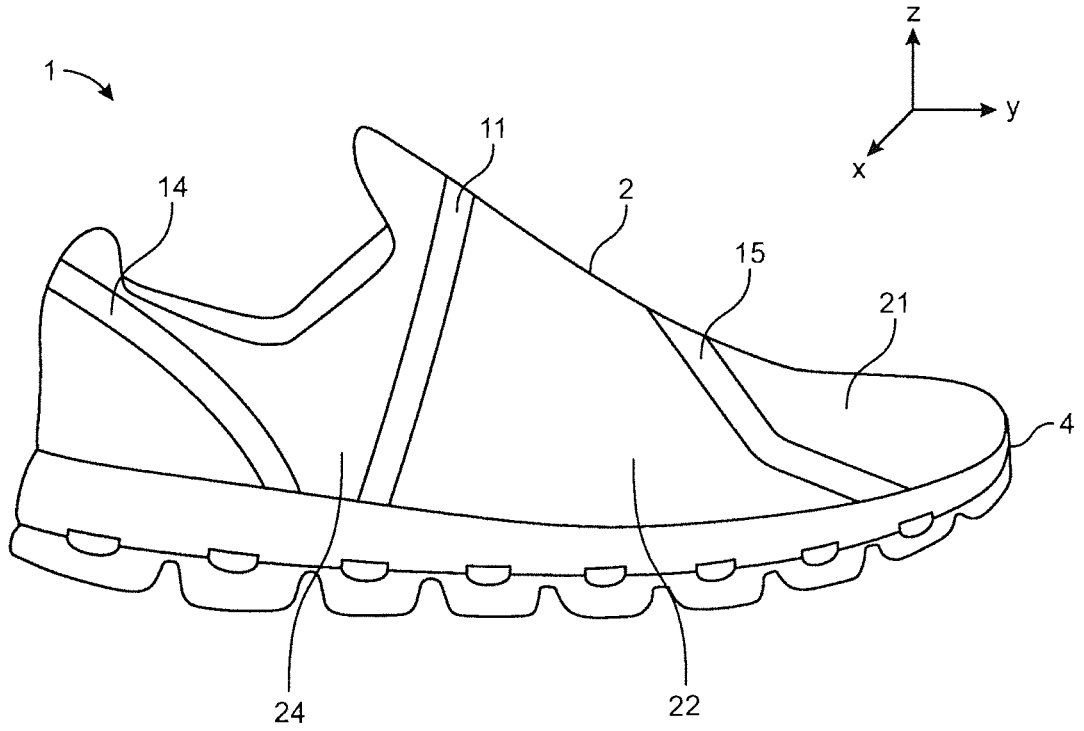
FIG. 3 shows a schematic view on the medial side of a running shoe according to a further embodiment of the invention.

FIG. 3 shows a further embodiment of the running shoe 1. In contrast to the running shoe from FIGS. 1 and 2, this one has only the first tension strap 15, as well as the first and fourth tension straps 14.

Figure 4:
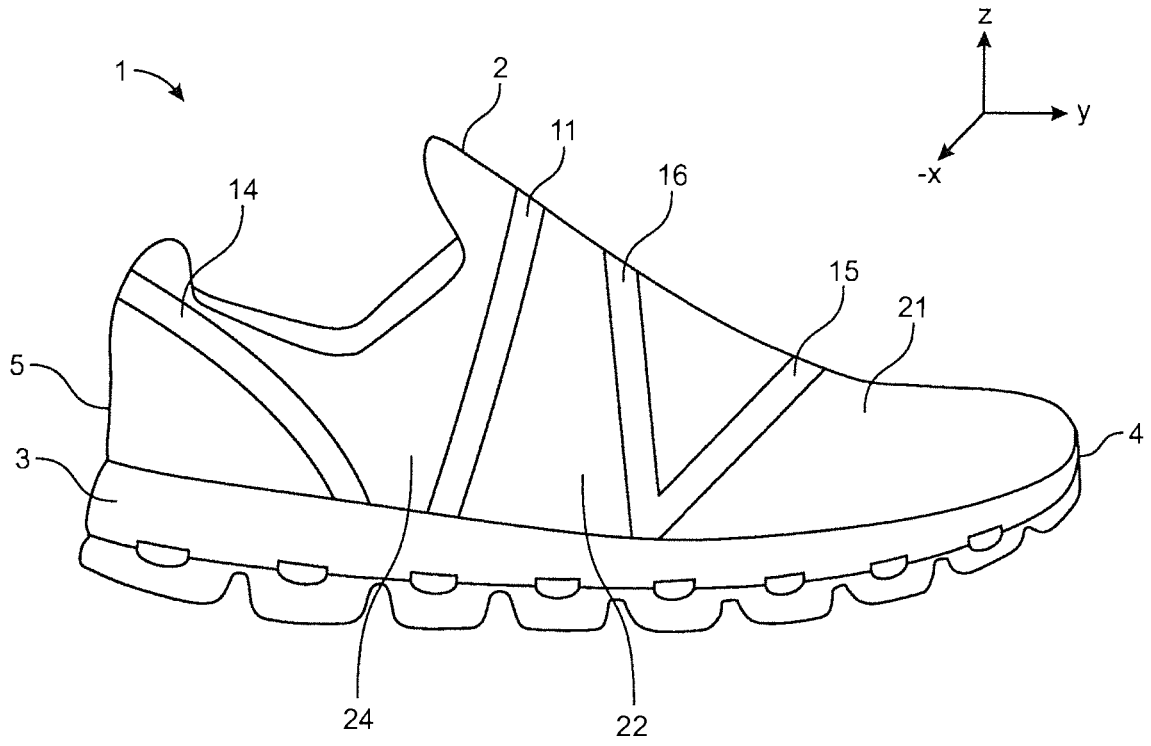
FIG. 4 shows a schematic view on the lateral side of a running shoe according to a further embodiment of the invention.

FIG. 4 shows a view on the lateral side of a running shoe according to a further embodiment of the invention. In contrast to the embodiment shown in FIG. 3, both the first and the second pulling strap 15 and 16 extend from the medial side over the lateral side and describe a V-shape. The second pulling strap 16 extends in the direction of the first pulling strap 15, but only comes into contact with the latter in the region of the shoe sole 3 on the lateral side.

Figure 5:
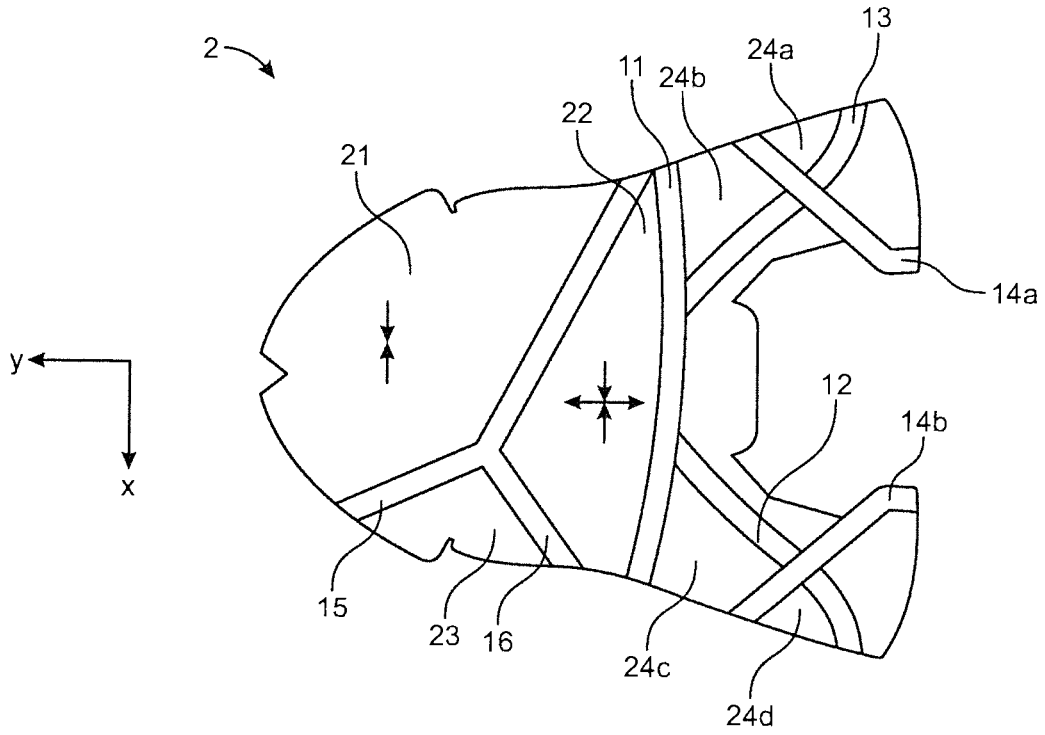
FIG. 5 shows a two-dimensional view of a so-called upper for an upper part of a running shoe according to the invention.

FIG. 5 shows a two-dimensional top view on an upper for an upper 2 of a fastener-free running shoe according to the invention with a group of tension straps comprising tension straps 11, 12, 13, as well as 14*a* and 14*b* and a group of pulling straps comprising pulling straps 15 and 16. The first pulling strap 15 runs from the front part of the hallux region on the medial side obliquely in the direction of the heel edge, i.e. in the negative y direction, the first pulling strap being angled at the connection position with the second pulling strap 16. The second pulling strap 16 extends from the rear of the hallux region on the medial side obliquely toward the shoe tip toward the first pulling strap 15 and merges with it at the connection position. The first pulling strap 15 divides the upper 2 in the forefoot area into a first functional zone 21 and a second functional zone 22, which is generally also delimited by the first tension strap 13. As indicated by the arrows, the first functional zone is longitudinally pre-tensioned and is force-neutral in the latitudinal direction. The second functional zone is pre-stretched in the longitudinal direction and pre-tensioned in the latitudinal direction. A third functional zone 23 is delimited by the first pulling strap 15 and the second pulling strap 16. This covers the hallux of the wearer when worn. The third functional zone is elastic and preferably force-neutral. The first compressive tension strap 11 extends in the midfoot area of the upper part 2 from the medial to the lateral side and, viewed in y direction, runs in front of the entry opening. When worn, the first tension strap 11 extends on a LONE of the wearer's foot. The second tension strap 12 and the third tension strap 13 run curved from the medial, respectively lateral side towards the first tension strap 11 and each merge into it at a connecting position. Thus, when worn, the tension straps 12 and 13 surround at least the ankles of the wearer's ankle. A fourth tension strap is formed by the tension straps 14*a* and 14*b*. These run from the heel edge towards the medial, or lateral side of the upper 2 and therefore surround the wearer's foot at least in the region of the Achilles tendon when worn. Thus, the wearer's foot is substantially completely surrounded on all sides by the tension straps 11, 12, 13, 14*a* and 14*b*. A fourth functional zone 24 is formed by the subzones 24*a-d* and is delimited by the first tension strap 11.

Figure 6:
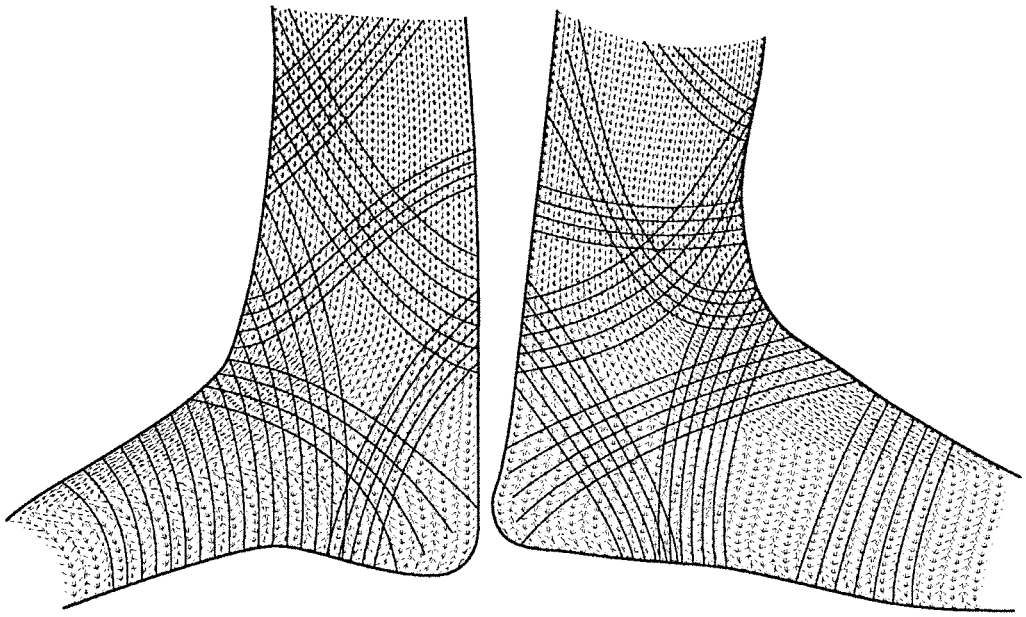
FIG. 6 shows a pair of feet of a wearer with the LONES running over the feet.

FIG. 6 shows a pair of feet of a wearer with the corresponding LONES. Comparison with FIG. 4 shows that the fourth tension strap runs over the LONES in the heel area and the first tension strap 11 runs over the LONES in the midfoot area over the foot. The group of LONES in the heel area, over which the fourth tension strap in FIG. 4 runs, run in the same direction over the foot of the wearer, as shown in FIG. 6, or are arranged at least in sections partially parallel to each other. This group of LONES thereby defines a range of LONES. The fourth tension strap is arranged exclusively above this area, or runs exclusively over this area.

The invention claimed is:

1. A running shoe (1) having a lateral side and a medial side, and comprising a heel area (FB), a forefoot area (VB), a midfoot area (MB), a shoe tip (4) and a heel edge (5), the running shoe (1) comprising:

a shoe sole (3) and an upper (2), wherein the upper (2) comprises a textile base material;

a group of tension straps comprising at least one compressive tension strap (11, 12, 13, 14), and a group of pulling straps comprising at least one compressive pulling strap (15, 16), the group of tension straps and the group of pulling straps being part of the upper (2) and optionally each extending into the shoe sole (3);

wherein the group of tension straps is arranged in the heel area (FB) and in the midfoot area (MB) of the running shoe and the group of pulling straps is arranged in the forefoot area (VB), and wherein the at least one tension strap (11, 12, 13, 14) is arranged along a non-expanding line (LONE) of a wearer's foot in a worn state and exerts an inwardly directed compression force;

wherein the group of tension straps comprises a first tension strap (11) extending from the medial side of the shoe sole (3) to the lateral side of the shoe sole (3) and being arranged in the midfoot area (MB) of the running shoe (1); and wherein the group of tension straps comprises a second tension strap (12), which extends on the medial side in the heel area (FB) and rises vertically from the shoe sole (3) at the heel edge (5) to the first tension strap (11).

2. The running shoe (1) according to claim 1, wherein the at least one pulling strap (15,16) is configured to exert a pulling force against a pronation of the wearer's foot in the worn state.

3. The running shoe (1) according to claim 1, wherein the group of pulling straps comprises a first pulling strap (15) which extends from the medial side of the shoe sole (3) to the lateral side of the shoe sole (3) and which exerts a pulling force between the medial side and the lateral side of the shoe sole (3).

4. The running shoe (1) according to claim 3, wherein the first pulling strap (15) divides the forefoot area (VB) of the upper (2) into a first functional zone (21) and a second functional zone (22), wherein the first functional zone (21) extends from the shoe tip (4) to the first pulling strap (15), and wherein the first functional zone (21) is pretensioned in a longitudinal direction of the running shoe and is force neutral or pretensioned in a latitudinal direction of the running shoe and/or wherein the second functional zone (22) is pretensioned in the latitudinal direction and is optionally pre-stretched in the longitudinal direction.

5. The running shoe (1) according to claim 3, wherein the group of pulling straps comprises a second pulling strap (16) extending from the shoe sole (3) on the medial side towards the first pulling strap (15) and exerting a pulling force in the direction of the first pulling strap.

6. The running shoe (1) according to claim 5, wherein the shoe sole (3), the first pulling strap (15) and the second pulling strap (16) define a third functional zone (23) which is formed elastically.

7. The running shoe (1) of claim 1, wherein the first tension strap (11) and the shoe sole (3) define a fourth functional zone (24) in the midfoot area and in the heel area which is force neutral in all directions.

8. The running shoe (1) according to claim 1, wherein the group of tension straps comprises a third tension strap (13) running on the lateral side in the heel area (FB) and extending vertically ascending from the shoe sole (3) at the heel edge (5) to the first tension strap.

9. The running shoe (1) according to claim 1, wherein the group of tension straps comprises a fourth tension strap (14), which, starting from the medial side of the shoe sole (3), extends in the heel area (FB) over the heel edge (5) to the lateral side of the shoe sole (3) and has an inclination in a vertical direction of the running shoe.

10. The running shoe (1) according to claim 9, wherein the group of tension straps define a fifth functional zone which is pretensioned in the longitudinal and latitudinal directions.

11. The running shoe (1) according to claim 1, wherein a group of tension straps (11, 12, 13, 14), and the group of pulling straps (15, 16), have a width of 0.5 to 4 cm.

12. The running shoe (1) according to claim 1, wherein the upper (2) comprises an auxetic transition region between the at least one tension strap (11, 12, 13, 14), and the textile base material and/or between the at least one pulling strap (15, 16), and the textile base material.

13. The running shoe (1) according to claim 1, wherein the at least one tension strap (11, 12, 13, 14) and/or the at least one pulling strap (15, 16) is connected to the shoe sole (3).

14. A running shoe (1) having a lateral side and a medial side, and comprising a heel area (FB), a forefoot area (VB), a midfoot area (MB), a shoe tip (4) and a heel edge (5), the running shoe (1) comprising:

a shoe sole (3) and an upper (2), wherein the upper (2) comprises a textile base material;

a group of tension straps comprising at least one compressive tension strap (11, 12, 13, 14), and a group of pulling straps comprising at least one compressive pulling strap (15, 16), the group of tension straps and the group of pulling straps being part of the upper (2) and optionally each extending into the shoe sole (3);

wherein the group of tension straps is arranged in the heel area (FB) and in the midfoot area (MB) of the running shoe and the group of pulling straps is arranged in the forefoot area (VB), and wherein the at least one tension strap (11, 12, 13, 14) is arranged along a non-expanding line (LONE) of a wearer's foot in a worn state and exerts an inwardly directed compression force;

wherein the group of tension straps comprises a first tension strap (11) extending from the medial side of the shoe sole (3) to the lateral side of the shoe sole (3) and being arranged in the midfoot area (MB) of the running shoe (1); and wherein the group of tension straps comprises a third tension strap (13) running on the lateral side in the heel area (FB) and extending vertically ascending from the shoe sole (3) at the heel edge (5) to the first tension strap.

15. The running shoe (1) according to claim 14, wherein the group of tension straps comprises a second tension strap (12), which extends on the medial side in the heel area (FB) and rises vertically from the shoe sole (3) at the heel edge (5) to the first tension strap (11).

16. The running shoe (1) according to claim 14, wherein the group of pulling straps comprises a first pulling strap (15) which extends from the medial side of the shoe sole (3) to the lateral side of the shoe sole (3) and which exerts a pulling force between the medial side and the lateral side of the shoe sole (3).

17. The running shoe (1) according to claim 16, wherein the first pulling strap (15) divides the forefoot area (VB) of the upper (2) into a first functional zone (21) and a second functional zone (22), wherein the first functional zone (21) extends from the shoe tip (4) to the first pulling strap (15), and wherein the first functional zone (21) is pretensioned in a longitudinal direction of the running shoe and is force neutral or pretensioned in a latitudinal direction of the running shoe and/or wherein the second functional zone (22) is pretensioned in the latitudinal direction and is optionally pre-stretched in the longitudinal direction.

18. The running shoe (1) according to claim 16, wherein the group of pulling straps comprises a second pulling strap (16) extending from the shoe sole (3) on the medial side towards the first pulling strap (15) and exerting a pulling force in the direction of the first pulling strap.

19. The running shoe (1) according to claim 14, wherein the group of tension straps comprises a fourth tension strap (14), which, starting from the medial side of the shoe sole (3), extends in the heel area (FB) over the heel edge (5) to the lateral side of the shoe sole (3) and has an inclination in a vertical direction of the running shoe.

20. The running shoe (1) according to claim 19, wherein the group of tension straps define a fifth functional zone which is pretensioned in the longitudinal and latitudinal directions.

* * * * *